US012376632B2

(12) United States Patent
Earls

(10) Patent No.: US 12,376,632 B2
(45) **Date of Patent: *Aug. 5, 2025**

(54) APPARATUS FOR RESTRICTING HEAD MOVEMENT

(71) Applicant: Derrick D. Earls, Chicago, IL (US)

(72) Inventor: Derrick D. Earls, Chicago, IL (US)

( * ) Notice: Subject to any disclaimer, the term of this patent is extended or adjusted under 35 U.S.C. 154(b) by 5 days.

This patent is subject to a terminal disclaimer.

(21) Appl. No.: 18/362,700

(22) Filed: Jul. 31, 2023

(65) Prior Publication Data

US 2024/0081436 A1 Mar. 14, 2024

Related U.S. Application Data

(63) Continuation of application No. 17/694,559, filed on Mar. 14, 2022, now Pat. No. 11,712,073, which is a continuation of application No. 16/552,452, filed on Aug. 27, 2019, now Pat. No. 11,272,748.

(51) Int. Cl.
*A41D 13/05* (2006.01)

(52) U.S. Cl.
CPC ..... *A41D 13/0512* (2013.01)

(58) Field of Classification Search
CPC ..... A41D 13/0512; A61F 5/055
See application file for complete search history.

(56) References Cited

U.S. PATENT DOCUMENTS 3,313,297 A 4/1967 Applegate et al.
3,455,300 A 7/1969 Hayner
3,713,657 A 1/1973 Presta
4,881,529 A * 11/1989 Santos ..... A41D 13/0512 2/415
5,003,968 A 4/1991 Mars
5,289,829 A 3/1994 Roehrig
(Continued)

FOREIGN PATENT DOCUMENTS

CN 208988345 U 6/2019
WO 2011067438 A2 6/2011
WO WO-2016023531 A1 * 2/2016 ..... A61F 5/055

OTHER PUBLICATIONS

International Search Report and Written Opinion dated Sep. 14, 2020 cited in Application No. PCT/US20/36731, 9 pgs.
(Continued)

*Primary Examiner* — Tajash D Patel
(74) *Attorney, Agent, or Firm* — BEKIARES ELIEZER LLP

(57) ABSTRACT

Disclosed herein is an apparatus for limiting head movement. The apparatus may comprise a shaft having a stem made of a substantially rigid material and one or more adjustable securing portions, the one or more adjustable securing portions configured to secure the stem to a neck of a user. The apparatus may include a chin support disposed at a first end of the stem and configured to contact a chin of the user. When secured to the user by the one or more adjustable securing portions, the chin support is configured to reduce vertical range of motion of a head of the user, and allow lateral range of motion of the head of the user. During a lateral rotation of the head of the user while the shaft is secured to the user, the shaft remains secured to the neck of the user and rotates with the head of the user, such that the chin support maintains contact with the chin of the user.

19 Claims, 4 Drawing Sheets

(56) References Cited

U.S. PATENT DOCUMENTS

| | | | |
|---|---|---|---|
| 6,058,517 | A | 5/2000 | Hartunian |
| 7,789,843 | B2 | 9/2010 | Ray |
| 11,272,748 | B2 | 3/2022 | Earls |
| 11,712,073 | B2 | 8/2023 | Earls |
| 2004/0084053 | A1 | 5/2004 | Hess |
| 2008/0223377 | A1 | 9/2008 | Kussick |
| 2009/0306562 | A1 | 12/2009 | Welch |
| 2010/0042030 | A1 | 2/2010 | Barnes |
| 2010/0168628 | A1 | 7/2010 | Hopfenspirger |
| 2011/0288459 | A1 | 11/2011 | Jenkins, III |
| 2013/0221168 | A1 | 8/2013 | Bernardoni |
| 2013/0333708 | A1 | 12/2013 | Hassan |
| 2016/0058601 | A1 | 3/2016 | Garth et al. |
| 2019/0038053 | A1 | 2/2019 | Brantingham |
| 2019/0350740 | A1 | 11/2019 | Maher |
| 2021/0059327 | A1 | 3/2021 | Earls |
| 2022/0202116 | A1 | 6/2022 | Earls |

OTHER PUBLICATIONS

International Preliminary Report on Patentability dated Mar. 10, 2022 cited in Application No. PCT/US20/36731, 8 pgs.
U.S. Non-Final Office Action dated Dec. 13, 2022 cited in U.S. Appl. No. 17/694,559, 17 pgs.
Chinese First Office Action mailed Mar. 27, 2025 cited in Application No. 202080074591.0 (w/ English language translations), 12 pgs.

* cited by examiner

APPARATUS FOR RESTRICTING HEAD MOVEMENT

RELATED APPLICATION

This application is a Continuation of U.S. application Ser. No. 17/694,559 filed on Mar. 14, 2022, which issues on Aug. 1, 2023 as U.S. Pat. No. 11,712,073, which is a Continuation of U.S. application Ser. No. 16/552,452 filed on Aug. 27, 2019, which issued on Mar. 15, 2022 as U.S. Pat. No. 11,272,748, which is incorporated herein by reference in its entirety.

It is intended that the referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to restricting head movement.

BACKGROUND

In some situations, beginner basketball players have a tendency to look down while dribbling a basketball. For example, during practice or a basketball game, many opportunities for passing or shooting may be lost from this tendency. Thus, the conventional strategy is to use "dribbling glasses" that black out the bottom half of a player's vision in order to impede looking down. This often causes problems because the conventional strategy does not account for alternate ways of looking down and observing the basketball. For example, the dribbling glasses may cause the player to develop other negative tendencies such as looking down at a sharper angle to bypass the vision blockers, or dribbling the basketball at a greater height to locate the basketball with the limited vision allowed from the dribbling glasses. A device for impeding a basketball player from looking down while dribbling is needed.

BRIEF OVERVIEW

This brief overview is provided to introduce a selection of concepts in a simplified form that are further described below. This brief overview is not intended to identify key features or essential features of the claimed subject matter. Nor is this overview intended to be used to limit the claimed subject matter's scope.

Disclosed herein are an apparatus and system for limiting head movement while, for example, but not limited to, dribbling a basketball. The apparatus may comprise a chin guard module. The chin guard module may comprise a shaft submodule and a chin surface submodule. The apparatus may further comprise at least one securing means. The securing means may comprise a connecting means and a fastening means.

In one embodiment, the present disclosure provides an apparatus comprising: a chin guard module comprising: a shaft submodule comprising: a stem portion made of a substantially rigid material, and one or more adjustable securing portions, the one or more adjustable securing portions configured to secure to a neck of a user, a chin surface submodule configured to contact a chin of the user, wherein the apparatus, when secured to the user, is configured to: reduce vertical range of motion of a head of the user, and allow lateral range of motion of the head of the user wherein during a lateral rotation of the head of the user while the apparatus is secured to the user, the following occurs: the chin guard module remains secured to the neck of the user and connected to the chin of the user, the chin guard module laterally rotates with the head of the user, and the one or more adjustable securing means remains stationary relative to the neck of the user.

In another embodiment, the present disclosure provides an apparatus comprising: a chin guard module configured to be concurrently applied to a neck and a chin of a user, the chin guard module being made substantially of a high density foam; and one or more adjustable securing portions connected to at least a portion of the chin guard module, the one or more adjustable securing means configured to secure the chin guard module to the neck of the user, wherein during a lateral rotation of the head of the user: the chin guard module remains secured to the neck of the user and the chin of the user, the chin guard module laterally rotates with the head of the user, and the one or more adjustable securing means remains stationary relative to the neck of the user.

In another embodiment, the present disclosure provides a head restricting system comprising: an upper portion made of a substantially rigid material, the upper portion being configured to contact a chin of a user; a lower portion positioned orthogonal to the to the upper portion, the lower portion being configured to connect to a neck of the user; and one or more securing portions configured to secure the upper portion and the lower portion to the user.

In yet another embodiment, an apparatus for limiting head movement is disclosed. The apparatus may comprise a shaft having a stem made of a substantially rigid material and one or more adjustable securing portions, the one or more adjustable securing portions configured to secure the stem to a neck of a user. The apparatus may include a chin support disposed at a first end of the stem and configured to contact a chin of the user. When secured to the user by the one or more adjustable securing portions, the chin support is configured to reduce vertical range of motion of a head of the user, and allow lateral range of motion of the head of the user. During a lateral rotation of the head of the user while the shaft is secured to the user, the shaft remains secured to the neck of the user and rotates with the head of the user, such that the chin support maintains contact with the chin of the user.

Still another embodiment discloses an apparatus comprising a chin support module configured to be removably secured to a neck of a user. The chin support module includes a shaft made of a substantially rigid material, and a chin support disposed at a first end of the shaft and configured to contact a chin of the user. The chin support module, when secured to the neck of the user, is configured to reduce vertical range of motion of a head of the user, and allow lateral range of motion of the head of the user. During a lateral rotation of the head of the user while the shaft is secured to the user, the shaft remains secured to the neck of the user and rotates with the head of the user, such that the chin support maintains contact with the chin of the user.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
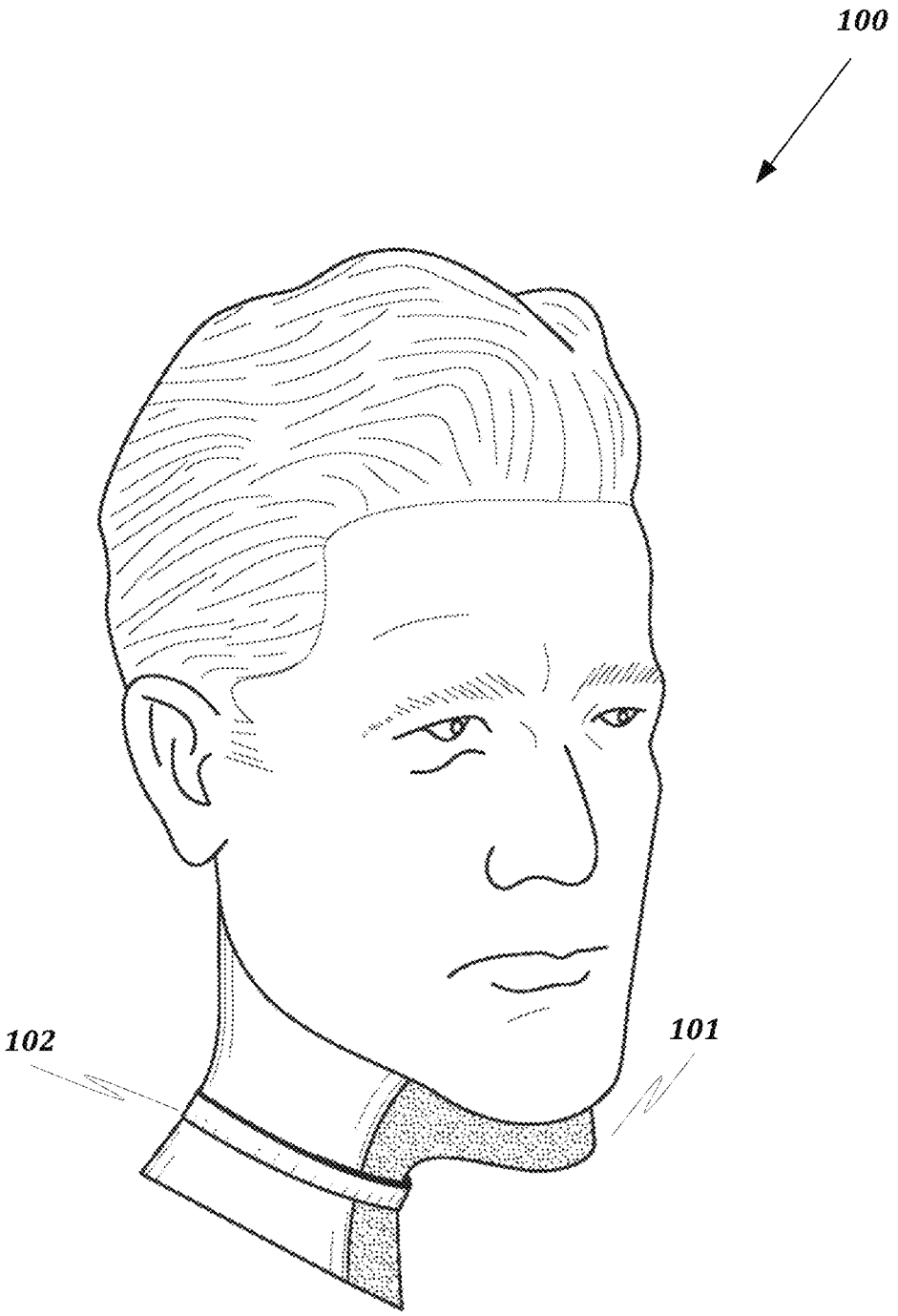
FIG. 1 is a left side view of an apparatus for restricting head movement.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of restricting head movement, embodiments of the present disclosure are not limited to use only in this context.

I. Apparatus Overview

This overview is provided to introduce a selection of concepts in a simplified form that are further described below. This overview is not intended to identify key features or essential features of the claimed subject matter. Nor is this overview intended to be used to limit the claimed subject matter's scope.

Embodiments of the present disclosure provide an apparatus for restricting head movement comprised of a set of elements, including, but not limited to a chin guard module, and at least one securing means. By way of non-limiting example, the securing means may connect to the chin guard module. In some embodiments, the securing means may comprise a connecting means. In further embodiments, the securing means may connect to a neck.

Embodiments of the present disclosure may comprise methods, systems, and components comprising, but not limited to, at least one of the following:

A. A Chin Guard Module; and

B. An at Least One Securing Means.

Details with regards to each component is provided below. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

The following depicts an example of a method of a plurality of methods that may be performed by at least one of the aforementioned components. Various hardware components may be used at the various stages of operations disclosed with reference to each component. For example, although methods may be described to be performed by a single apparatus, it should be understood that, in some embodiments, different operations may be performed by different apparatuses in operating in conjunction with each other. For example, an apparatus 100 may be employed in the performance of some or all of the stages disclosed with regard to the methods. Similarly, one apparatus may be employed in the performance of some or all of the stages of the methods. As such, the apparatus may comprise at least one of the architectural components disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

A chin guard module may be provided. A shaft submodule consistent with the embodiments of the current disclosure may connect to a chin surface submodule. The shaft submodule connected to the chin surface submodule may create an inverted "L" shape. In this way, the chin guard module may conform to the neck and a chin.

An at least one securing means may be provided. The at least one securing means, consistent with the embodiments of the current disclosure may comprise a connecting means. The connecting means may connect the securing means to the neck. In this way, apparatus 100 may be secured to the neck.

II. Apparatus and System Configuration

Figure 2:
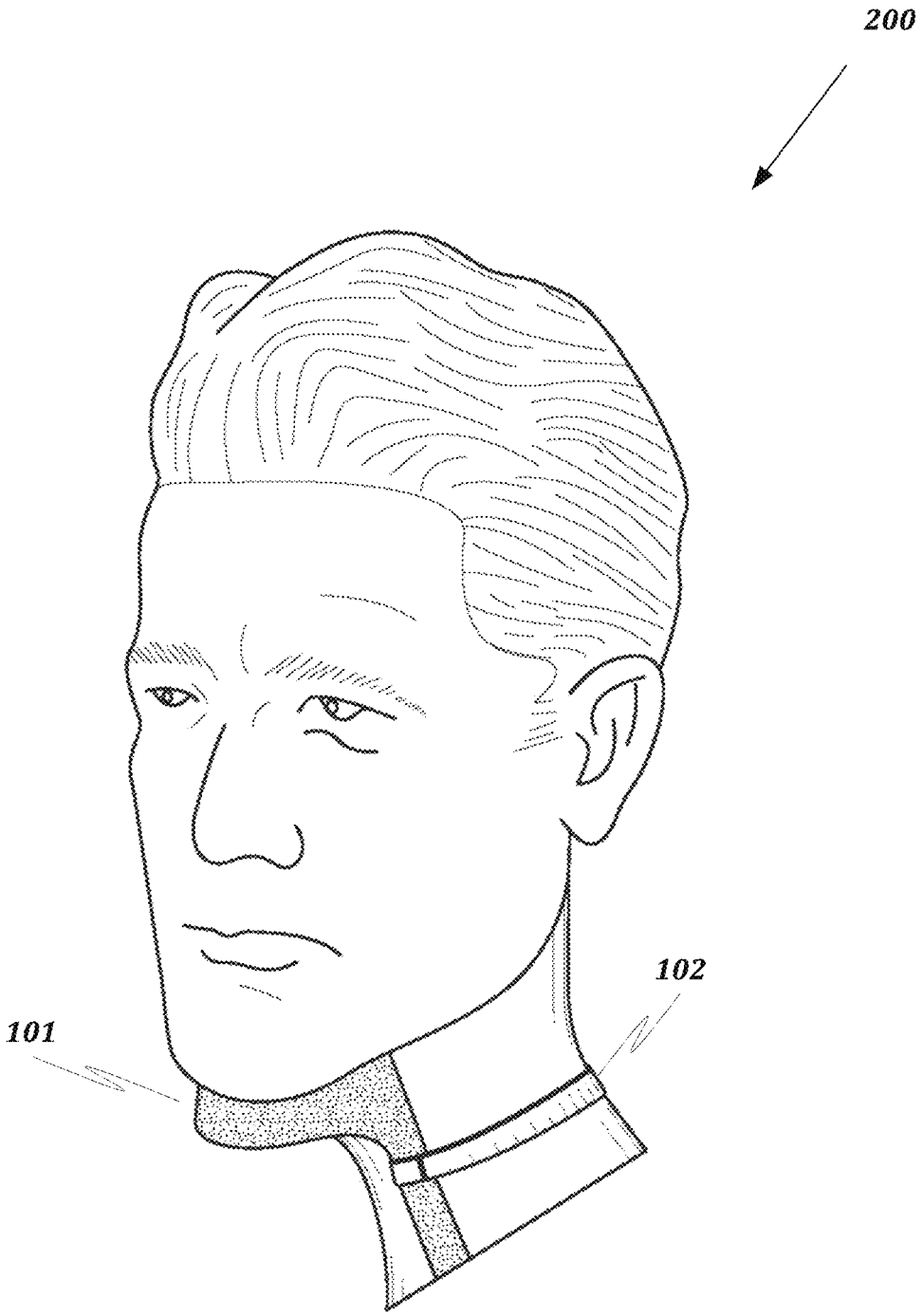
FIG. 2 is a right side view thereof.

FIGS. 1 and 2 illustrates one possible operating environment through which apparatus 100 consistent with embodiments of the present disclosure may be provided. Accordingly, embodiments of the present disclosure provide an apparatus for restricting head movement comprised of a set of elements, including, but not limited to a chin guard module and an at least one securing means.

A. Chin Guard Module

Figure 3:
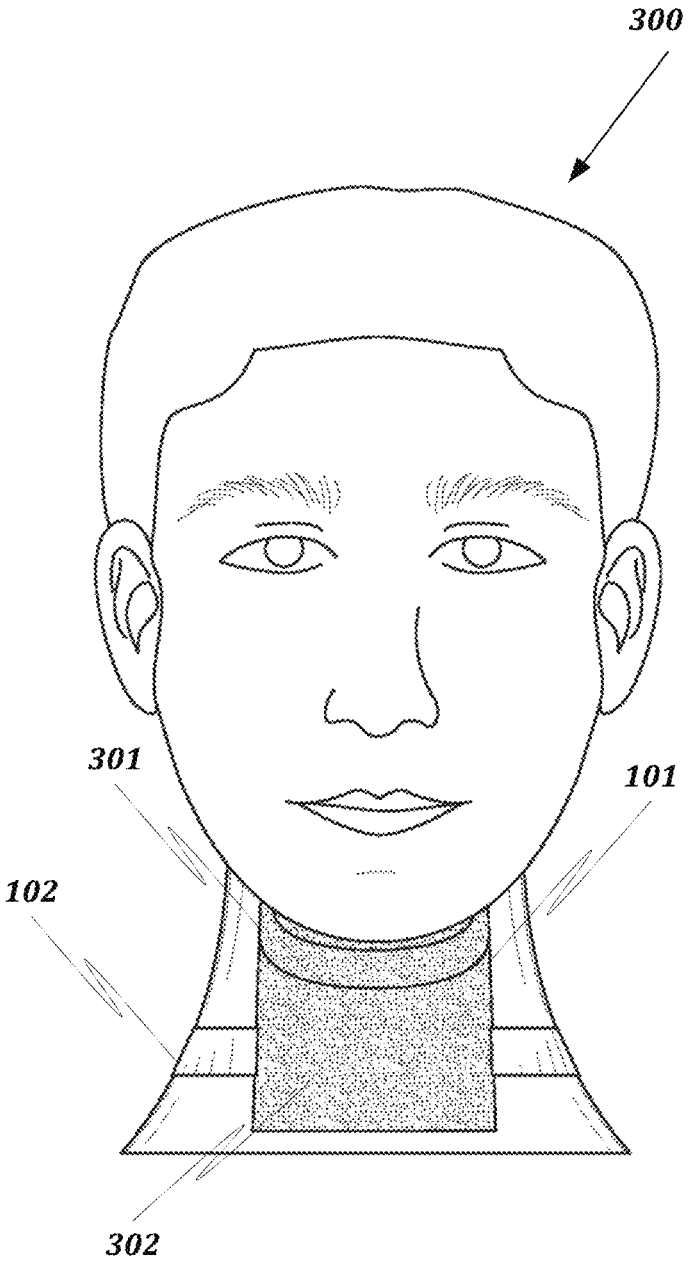
FIG. 3 is a forward facing view thereof.
Figure 4:
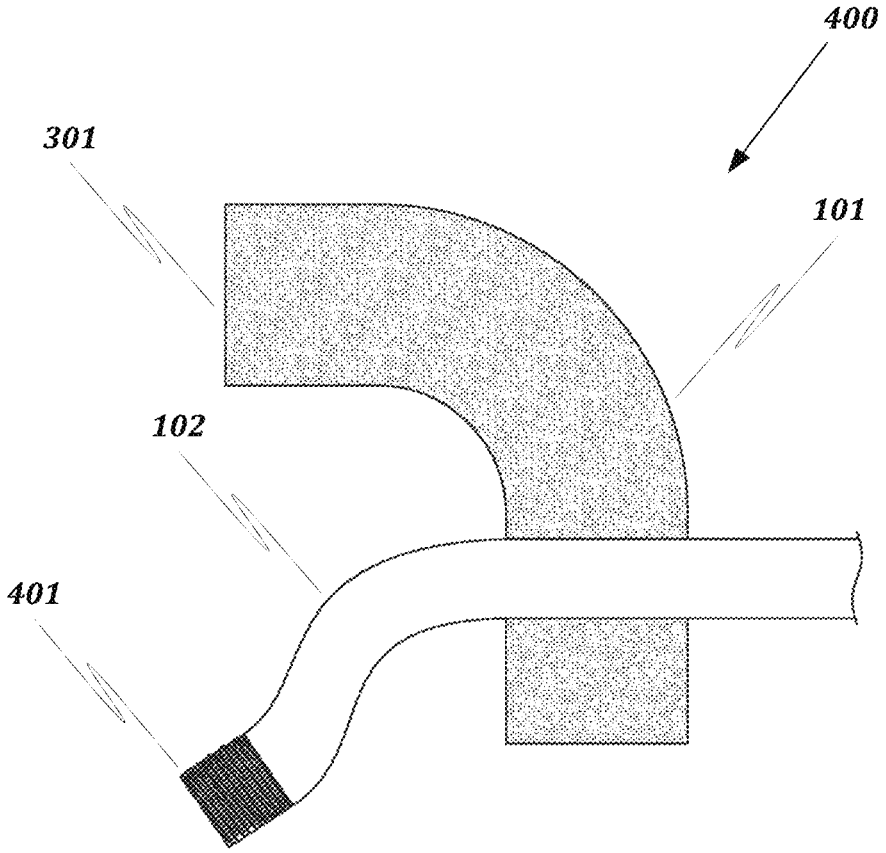
FIG. 4 is a perspective view thereof.

FIG. 3 illustrates a chin guard module 101 comprising a shaft submodule 302 and a chin surface submodule 301.

Chin surface submodule 301 may comprise a curved surface. In this way, chin guard module 101 may provide a surface for the chin to be ergonomically applied to the apparatus 100.

Chin surface submodule 301 may comprise a plurality of interchangeable surfaces. In this way, chin guard module 101 may provide a surface that can accommodate a plurality of different users' chin types and forms, thereby enabling a comfortable fit.

In some embodiments, the plurality of interchangeable surfaces may comprise a surface comprising a plurality of protrusions. The chin guard module 101 may be positioned against the user's chin and neck, such that the shape and protrusions impede the user from lowering their chin.

Shaft submodule 302 may comprise a plurality of surfaces, and at least one aperture. In some embodiments, the plurality of surfaces may connect. In this way, the plurality of surfaces may form an external housing. In further embodiments, the connected plurality of surfaces may be continuous. In this way, apparatus 100 may minimize edges and protrusions created from the connecting surfaces. In other embodiments, the connected plurality of surfaces may meet to form an at least one edge. In this way, the shaft submodule may more rigidly adhere to the user's neck.

In some embodiments, shaft submodule 302 may be rigid. In other embodiments, shaft submodule 302 may be retractably extendable. In this way, the chin guard may accommodate for a plurality of neck lengths, shapes, and forms.

In some embodiments, shaft submodule 302 connected to chin surface submodule 301 may create an inverted "L" shape. In this way, apparatus 100 may concurrently be applied to the user's neck and chin, thereby providing a rigid structure that prevents chin surface submodule 301 from bending, or from bending beyond a certain angle relative to shaft submodule 302. It should be understood that any shape to achieve the same function may be employed, and that chin surface submodule 301 and shaft submodule 302 may be comprised of a single, continuous, and/or uniform material.

B. At Least One Securing Means

FIG. 3 illustrates at least one securing means 102 comprising a connecting means and a fastening means. Employing the connection means and the fastening means, at least one securing means 102 may be used to secure apparatus 100 to the user. At least one securing means 102 may connect and be fastened to apparatus 100 via chin guard module 101.

By way of non-limited example, in some embodiments, at least one securing means 102 may be fastened to chin guard module 101 through shaft submodule 302. In further embodiments, at least one securing means 102 may connect to chin guard module 101 through the at least one aperture of shaft submodule 302. In this way, the fastening means may secure at least one securing means 102 to the user's neck. In turn, at least one securing means 102 may prevent undesired movement of apparatus 100 when secured to the user's neck. By way of non-limiting example, the fastening means may comprise the following:

1. a hook and loop material, such as, for example Velcro™;
2. a clasp;
3. a clamp;
4. a latch;
5. a lock;
6. a fastener;
7. a buckle;
8. a harness; or
9. a clip.

In some embodiments, the connecting means may comprise an expandable material. In this way, at least one securing means 102 may adjust for a plurality of neck sizes. In other embodiments, the connecting means may comprise a rigid material. In this way, at least one securing means 102 may connect to the neck immovably. In still other embodiments, the connecting means may comprise a pliable material on at least one side. In this way, comfort may be increased when apparatus 100 is used.

It should be understood that at least one securing means 102 may be secured to other portions of the user, via other portions of chin guard 101. For example, at least one securing means 102 may be connected to and/or fastened against chin guard module 101. Moreover, in various embodiments, chin guard 101 may be integrated into, for example, but not limited to, a headgear, or any other object worn by the user and fastened thereto.

III. Apparatus and System Use

Embodiments of the present disclosure provide apparatus 100 operative by a set of comprising instructions configured to operate the aforementioned modules in accordance with the methods. The following depicts an example of a method of a plurality of methods that may be performed by at least one of the aforementioned modules. Various hardware components may be used at the various stages of operations disclosed with reference to each module.

Embodiments of the present disclosure provide apparatus 100 operative as a distributed system of modules. The method may comprise the following stages:

Embodiment 1

1. Connecting at least one securing means 102 to chin guard module 101;
2. Connecting apparatus 100 to the neck with the connecting means; and
3. Securing apparatus 100 to the neck with the fastening means.

Embodiment 2

1. Connecting at least one securing means 102 to chin guard module 101;
2. Retractably extending shaft submodule 302 to a desired height;
3. Connecting apparatus 100 to the neck with the connecting means; and
4. Securing apparatus 100 to the neck with the fastening means.

Embodiment 3

1. Connecting at least one securing means 102 to chin guard module 101;
2. Connect a surface from the plurality of interchangeable surfaces to chin surface submodule 301;
3. Connecting apparatus 100 to the neck with the connecting means; and
4. Securing apparatus 100 to the neck with the fastening means.

Embodiment 4

1. Connecting at least one securing means 102 to chin guard module 101;
2. Connect a surface from the plurality of interchangeable surfaces to chin surface submodule 301;
3. Retractably extending shaft submodule 302 to a desired height;
4. Connecting apparatus 100 to the neck with the connecting means; and
5. Securing apparatus 100 to the neck with the fastening means.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

IV. Aspects

The following disclose various Aspects of the present disclosure. The various Aspects are not to be construed as patent claims unless the language of the Aspect appears as a patent claim. The Aspects describe various non-limiting embodiments of the present disclosure.

1. Chin Guard Module
   - a. Shaft Submodule
     - i. Comprises at least one aperture.
       1. In this way, the chin guard may connect to the securing means.
     - ii. Comprises a plurality of surfaces.
       1. In this way, the shaft module and the chin surface module may connect to form at least one edge.
   - b. Chin Surface Submodule
     - i. Comprises a plurality of interchangeable surfaces.
       1. Smooth curved surface.
          - a. In this way, the chin guard may provide a surface for the chin to rest.
       2. Comprises a plurality of protrusions.
          - a. May provide a surface for deterrence for lowering the chin.
   - c. Materials and Structure
     - i. High density foam.
       1. In this way, the chin guard module may have lower weight with structural integrity.

ii. Rigid (non-malleable).
iii. Adjustable (retractably extendable).
1. In this way, the chin guard may accommodate for a plurality of neck lengths.
iv. Continuous surface.
v. Inverted "L" shape.
1. In this way, the chin guard module may conform to the neck and chin.

2. At Least One Securing Means
a. Connecting Means
i. In this way, the securing means may connect around the neck.
b. Fastening Means
c. Aspects
i. Expandable material.
ii. Secured around the neck to prevent movement of chin guard.
d. Embodiments
i. Connect to the chin.
ii. Expandable material.
1. In this way, the securing means may adjust for a plurality of neck sizes.
iii. Rigid material.
1. In this way, the securing means may connect around the neck immovably.
iv. Locking mechanism.
v. Connecting element/securing means (Velcro, latch, etc.).
vi. Retractably extendable.
vii. Velcro surface end.
1. In this way, the apparatus may easily detach from the neck.
viii. Pliable surface end.
1. In this way, the soft surface end may provide comfort while the apparatus is connected to the neck.

In another aspect, an apparatus comprises:
a chin guard module comprising:
a shaft submodule comprising:
a stem portion made of a substantially rigid material, and
one or more adjustable securing portions, the one or more adjustable
securing portions configured to secure to a neck of a user,
a chin surface submodule configured to contact a chin of the user,
wherein the apparatus, when secured to the user, is configured to:
reduce vertical range of motion of a head of the user, and
allow lateral range of motion of the head of the user,
wherein during a lateral rotation of the head of the user while the apparatus is secured to the user, the following occurs:
the chin guard module remains secured to the neck of the user and connected to the chin of the user,
the chin guard module laterally rotates with the head of the user, and
the one or more adjustable securing means remains stationary relative to the neck of the user.

V. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. An apparatus comprising:
a shaft having a stem made of a substantially rigid material and one or more adjustable securing portions, the one or more adjustable securing portions configured to secure the stem to a neck of a user; and
a chin support disposed at a first end of the stem and configured to contact a chin of the user;
wherein, when secured to the user by the one or more adjustable securing portions, the chin support is configured to:
reduce vertical range of motion of a head of the user, and
allow lateral range of motion of the head of the user,
wherein, during a lateral rotation of the head of the user while the shaft is secured to the user, the shaft remains secured to the neck of the user and rotates with the head of the user, such that the chin support maintains contact with the chin of the user.

2. The apparatus of claim 1, wherein the chin support comprises an inner surface and an outer surface.

3. The apparatus of claim 2, wherein the inner surface of the chin support is configured to contact the chin of the user.

4. The apparatus of claim 3, wherein at least a portion of the inner surface of the chin support comprises a malleable portion, the malleable portion being configured to conform to the chin of the user.

5. The apparatus of claim 1, wherein the chin support comprises a plurality of interchangeable surfaces.

6. The apparatus of claim 1, wherein each of the one or more adjustable securing portions comprises:
a connecting portion for connecting the adjustable securing portion to the shaft, and
a fastening means for fastening to or around the neck of the user.

7. The apparatus of claim 6, wherein the fastening means comprises one or more of the following:
a hook and loop material;
a clasp;
a clamp;
a latch;
a lock;
a fastener;
a buckle;
a harness; and
a clip.

8. The apparatus of claim 1, wherein the stem comprises a retractably extendable portion.

9. The apparatus of claim 1, wherein the chin support comprises a retractably extendable portion.

10. The apparatus of claim 1, wherein the chin support is oriented substantially orthogonally to the stem.

11. The apparatus of claim 1, wherein the stem comprises one or more apertures, wherein at least one of the one or more adjustable securing portions is secured to the stem portion of the shaft via the one or more apertures.

12. The apparatus of claim 1, wherein a portion of the chin support connects to the stem.

13. An apparatus comprising:

a chin support module configured to be removably secured to a neck of a user, the chin support module comprising:

a shaft made of a substantially rigid material, and a chin support disposed at a first end of the shaft and configured to contact a chin of the user, wherein the chin support module, when secured to the neck of the user, is configured to:

reduce vertical range of motion of a head of the user, and allow lateral range of motion of the head of the user, wherein, during a lateral rotation of the head of the user while the shaft is secured to the user, the shaft remains secured to the neck of the user and rotates with the head of the user, such that the chin support maintains contact with the chin of the user.

14. The apparatus of claim 13, further comprising one or more adjustable securing means, wherein each of the one or more securing means comprises:

a connecting portion for connecting the adjustable securing means to the shaft, and a fastening means for fastening to or around the neck of the user.

15. The apparatus of claim 13, wherein at least a portion of the chin support module is formed from a high density foam.

16. The apparatus of claim 13, wherein the chin support comprises an inner surface and an outer surface, and wherein the inner surface of the chin support is configured to contact the chin of the user.

17. The apparatus of claim 13, wherein the shaft is retractably extendable.

18. The apparatus of claim 13, wherein the chin support is retractably extendable.

19. The apparatus of claim 13, wherein the chin support is oriented substantially orthogonal to the shaft.

* * * * *